US006216819B1

(12) United States Patent
Cougar

(10) Patent No.: US 6,216,819 B1
(45) Date of Patent: Apr. 17, 2001

(54) KNEELING BOARD FOR ROOFERS

(76) Inventor: Daniel D. Cougar, 13661 Van Dorn Rd., Manassas, VA (US) 22111

( * ) Notice: Subject to any disclaimer, the term of this patent is extended or adjusted under 35 U.S.C. 154(b) by 0 days.

(21) Appl. No.: 09/116,608

(22) Filed: Jul. 16, 1998

Related U.S. Application Data

(60) Provisional application No. 60/052,630, filed on Jul. 16, 1997.

(51) Int. Cl.[7] ..... A43B 3/00
(52) U.S. Cl. ..... 182/45; 182/230
(58) Field of Search ..... 182/230, 45

(56) References Cited

U.S. PATENT DOCUMENTS 3,382,503 * 5/1968 Ramon ..... 182/230
3,499,502 * 3/1970 Rosander ..... 182/230
3,726,028 * 4/1973 Stokes .
4,491,193 * 1/1985 Moss .
5,125,479 * 6/1992 Nemes ..... 182/230

* cited by examiner

*Primary Examiner*—Alvin Chin-Shue
(74) *Attorney, Agent, or Firm*—Miles & Stockbridge P.C.; John C. Kerins

(57) ABSTRACT

A kneeling board having a replaceable anti-slip pad for use on sloping surfaces is provided wherein the kneeling board is provided with a sheet or layer of hook fasteners of the hook-and-loop type fastener system disposed on underside thereof, and wherein a replaceable anti-slip pad is provided having a sheet or layer of the complementary loop elements provided on a flat surface thereof. The anti-slip pad is constructed of a high density, closed-cell foam that provides greatly improved traction on roofing surfaces, thereby improving the ability to securely place the kneeling board on the sloping surface without substantial slipping, which improves worker safety and productivity or efficiency. The kneeling board has a kneeling pad disposed on an upper surface thereof, and has a foothold projection extending upwardly from the upper surface at an edge of the board, and at a distance spaced apart from the kneeling pad, so as to create a channel into which the worker may secure his feet.

16 Claims, 3 Drawing Sheets

KNEELING BOARD FOR ROOFERS

This application claims the benefit of Provisional Application 60/052630 filed on Jul. 16, 1997.

BACKGROUND OF THE INVENTION

1. Field of the Invention

The present invention is directed to a kneeling board for roofers, having an anti-slip pad for attachment to the underside of the board. The kneeling board is especially well suited for use by roofers and others working on steeply inclined surfaces.

2. Description of Related Art

Roofers and other construction workers that commonly work on steeply inclined surfaces often have difficulty maintaining their working positions, and roofers, especially, end up doing a considerable amount of their work while kneeling on the inclined surface.

The rough surface texture of the plywood sheathing, the backing paper, and especially of the commonly-used asphalt shingles, generally provides adequate frictional forces to hold the worker's knees and feet in place.

However, the hardness of those materials makes working on one's knees extremely uncomfortable and the worker must therefore take frequent breaks to relieve the pressure from the knees. In addition, the abrasiveness of these roofing materials quickly wears out the knee areas of the worker's clothing and greatly accelerates the wear on the shoe soles. The stone gravel that makes up the upper surface of asphalt shingles is highly abrasive, and the gravel texture can produce extremely uncomfortable pressure concentration on the worker's knees at the points of contact between the knees and the pieces of gravel.

While there are oftentimes foot supports temporarily attached to the roof to provide the roofer with more secure footing, and to relieve, to a limited extent, the pressure on the worker's knees, such supports do not provide adequate comfort to improve worker efficiency by reducing the number or length of work breaks.

A roofing aid on which the roofer can sit or kneel was proposed in U.S. Pat. No. 4,230,202. That roofing aid employs an anti-slip underlayer substantially permanently affixed into a frame, which has a sitting or kneeling surface as its upper surface. That roofer's aid further does not provide a foothold surface for retaining a secure footing on the device when the worker is working from a kneeling position.

It is a principal object of the present invention to provide a kneeling board for use in working on inclined surfaces that has an easily removable and replaceable anti-slip pad at the underside of the board, a resilient kneeling pad on an upper surface of the board, and a foot-engaging projection portion on the board, whereby a worker can kneel on the pad and secure his foot or feet against the projection.

It is another principal object of the present invention to provide a kneeling board that will remain in place on a sloped roof surface, and which provides a comfortable kneeling surface for the worker, and which provides an area at which the worker can secure his feet or toes to gain a foothold on the kneeling board.

SUMMARY OF THE INVENTION

The above and other objects of the present invention are achieved by removably securing a foam pad to an underside of a substantially rigid board element, and providing a resilient kneeling pad on an upper surface of the board element. The invention further achieves the above objects by providing an upwardly projecting flange extending preferably substantially perpendicular to the plane of the board element, and spaced apart from an edge of the kneeling pad, so as to create a channel for insertion of the worker's shoed feet or toes, such that the worker can gain a foothold on the kneeling board itself. This greatly improves the worker's stability and further distributes the worker's weight, to some degree, between the knees and the feet, when kneeling.

The foam pad will engage the roofing surface and will deform under the weight of the kneeling board, and/or the worker, such that the pad will securely grip the surface and substantially prevent the kneeling board from sliding along the surface. The removable foam pad is preferably secured to the underside of the board by hook-and-loop fasteners, such that, when the foam pad becomes worn, it can be readily replaced by a new pad.

To obtain the desired anti-slip or gripping properties, while maintaining a reasonable measure of durability, which are two competing interests, it has been determined that both open- and closed-cell foam materials provide an excellent combination of these properties.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

DETAILED DESCRIPTION OF THE PREFERRED EMBODIMENTS

Figure 1:
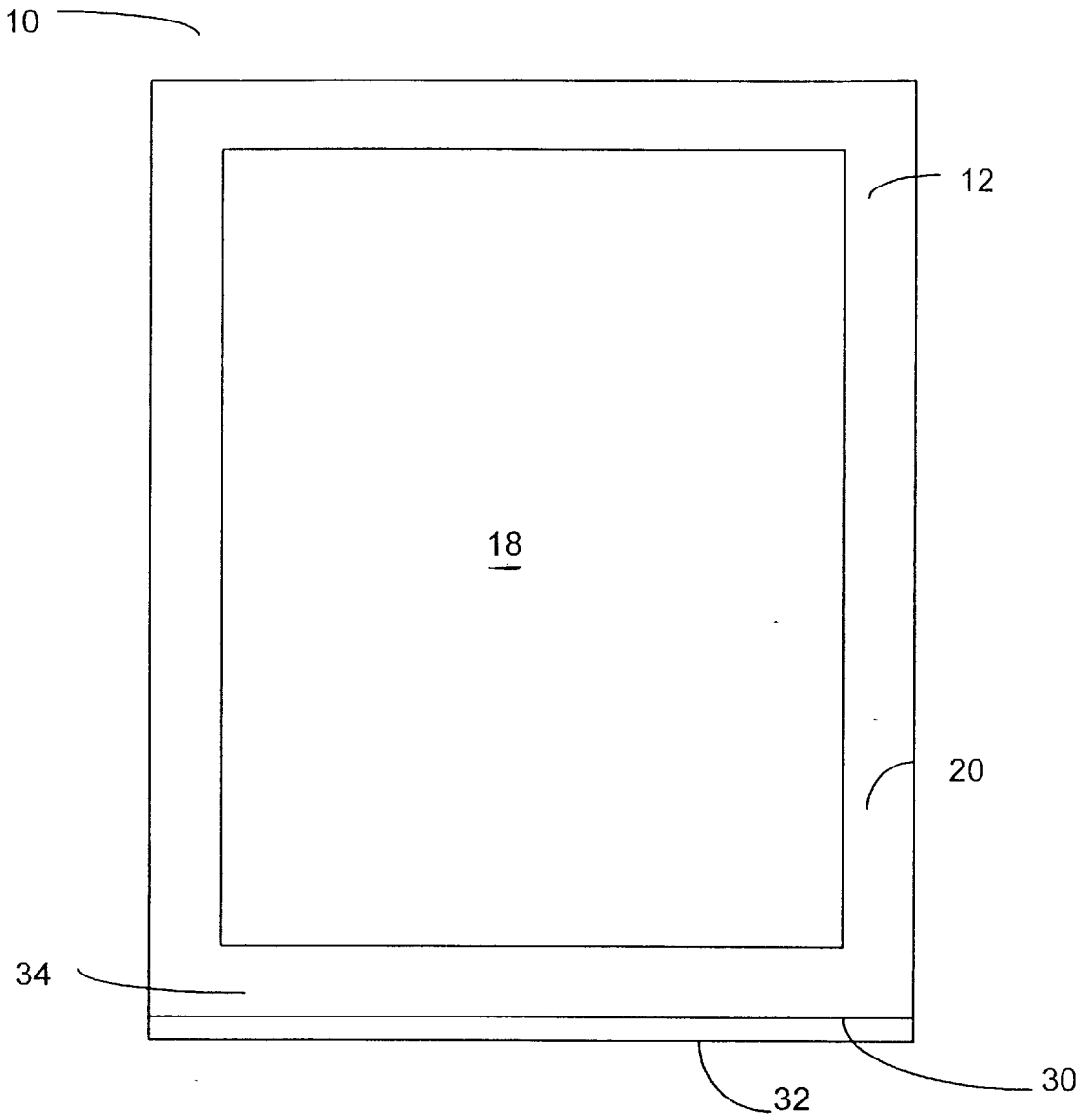
FIG. 1 is a top plan view of a kneeling board according to a preferred embodiment of the invention.
Figure 2:
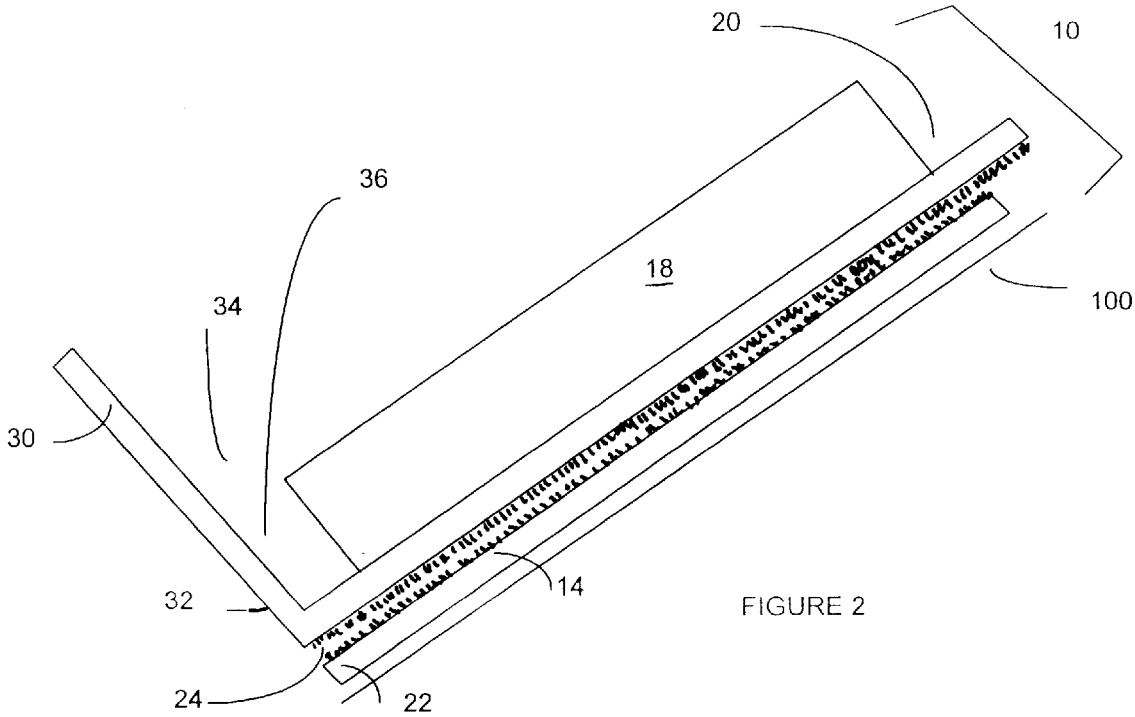
FIG. 2 is a side view of a kneeling board having a replaceable anti-slip pad secured thereto, wherein the kneeling board is laid on its side on a sloping surface.

Referring to FIGS. 1 and 2, a kneeling board generally designated at 10 is illustrated. The kneeling board 10 preferably comprises a substantially rigid board element 12 having an anti-slip pad 14 releaseably attached to an underside 16 of the board element. The board element 12 further preferably has a kneeling pad 18 secured to an upper surface 20 of the board element. Finally, the board element 12 itself preferably has a flange or projection 30 extending perpendicularly upwardly from the upper surface 20 of the board element, along one edge, termed the downslope edge 32 of the kneeling board.

Board element 12 is preferably constructed of a substantially rigid plastic or polymer sheet material. As used herein, the term "substantially rigid" is intended to mean of sufficient rigidity to render the kneeling board assembly self-supporting and shape retaining, without the need for brackets, frames, or other reinforcing elements. The board element may preferably be on the order of 0.375 inches thick. Other suitable materials and thickness will be readily apparent to persons skilled in the art upon reading this disclosure.

As best seen in FIG. 1, the plan shape of the upper surface 20 of the board element 12 is rectangular, and the preferred dimensions are 24 inches on the short edge, of which downslope edge 32 is one, by 30 inches. The worker's feet will generally be at downslope edge 32, and the worker's knees will fall somewhere in the center of the kneeling pad 18. The additional length, to the 30-inch length, is provided to give the worker space to rest his or her hands, and/or to place work materials in a convenient location. The kneeling pad 18 extends across the vast majority of the upper surface 20 of board element 12, extending to within approximately two (2) inches of each edge of the board element.

As seen in FIG. 2, the kneeling pad 18 projects upwardly from upper surface 20 of board element 12. The kneeling pad 18 is preferably made of a closed-cell foam material, having a thickness of two (2) inches. The kneeling pad is preferably substantially permanently secured to upper surface 20, as by gluing.

Alternatively, the pad 18 may be removably secured, as discussed in greater detail herein with respect to anti-slip pad 14. The closed-cell foam provides some water-absorption resistance. The pad 18 may, however, further be coated with a water-impervious coating, such as a nylon film or coating, or other known coatings used on closed-cell foam products. Open-cell foam layers could also be used for this kneeling pad, however, open-cell foams will generally require the use of the water-impervious coating to impart resistance to absorbing water.

While the preferred characteristics for the kneeling pad have been discussed herein, it will be readily apparent that the main purpose and function of the kneeling pad is to provide cushioning for the worker's knees, and any material suitable for such use may be employed for kneeling pad 18.

Projection 30 provides an important feature in the present invention. Pad 18 is deliberately spaced apart from projection 30, so as to create a channel 34 bounded on three sides by the projection 30, the upper surface 20 of board element 12, and the side surface 36 of kneeling pad 18. The projection preferably extends to a greater distance away from upper surface 20 then does kneeling pad 18. In a preferred embodiment, projection 30 would extend five (5) inches from the upper surface 20.

The channel 34 allows the worker, after the worker is kneeling at a desired location on the kneeling board 10, to secure his feet or toes (in shoes) against the projection 30, and inserted into channel 34. This provides the worker with a secure foothold on the kneeling board 10, thereby increasing the stability of the worker. The ability to gain such a foothold further allows the worker to distribute his weight, to some degree, between his knees and his feet, to further remove load from the knees.

The edge at which projection 30 is located is referred to as the downslope edge because the worker will generally work with his feet below his body and head, and thus the projection will be oriented by the worker such that the projection will be "downslope" from the remainder of the kneeling board 10.

The kneeling board of the present invention is designed for long-lasting life. The anti-slip pads are subjected to accelerated wear when used on roofing surfaces, particularly the asphalt shingles, thus severely curtailing the service life of a simple pad. It has been determined, in accordance with the present invention, that the desired combination of high traction and increased service life is obtained by providing a removable and replaceable open-cell or closed-cell foam pad 14 secured to the underside 16 of the kneeling board 10 that would normally be in contact with the sloped surface when the kneeling board is placed on the surface.

When the roofer positions the kneeling board 10 in a desired work location on a roof 100 or other sloping surface, the anti-slip pad 14 engages the roof surface 100, whether it is the bare plywood sheathing, the backing paper, or, most often, the gravel surface of an asphalt shingle. The material for the pad is selected to be substantially resilient, such that the weight of the kneeling board will cause the foam pad to deform at least slightly under the weight of the board, to securely engage the roof surface, and to increase the area of contact and frictional forces between the roof surface and the pad 14. The foam pad will deform to a much greater extent providing extremely secure engagement, once the weight of the worker is added to the kneeling board.

Figure 3:
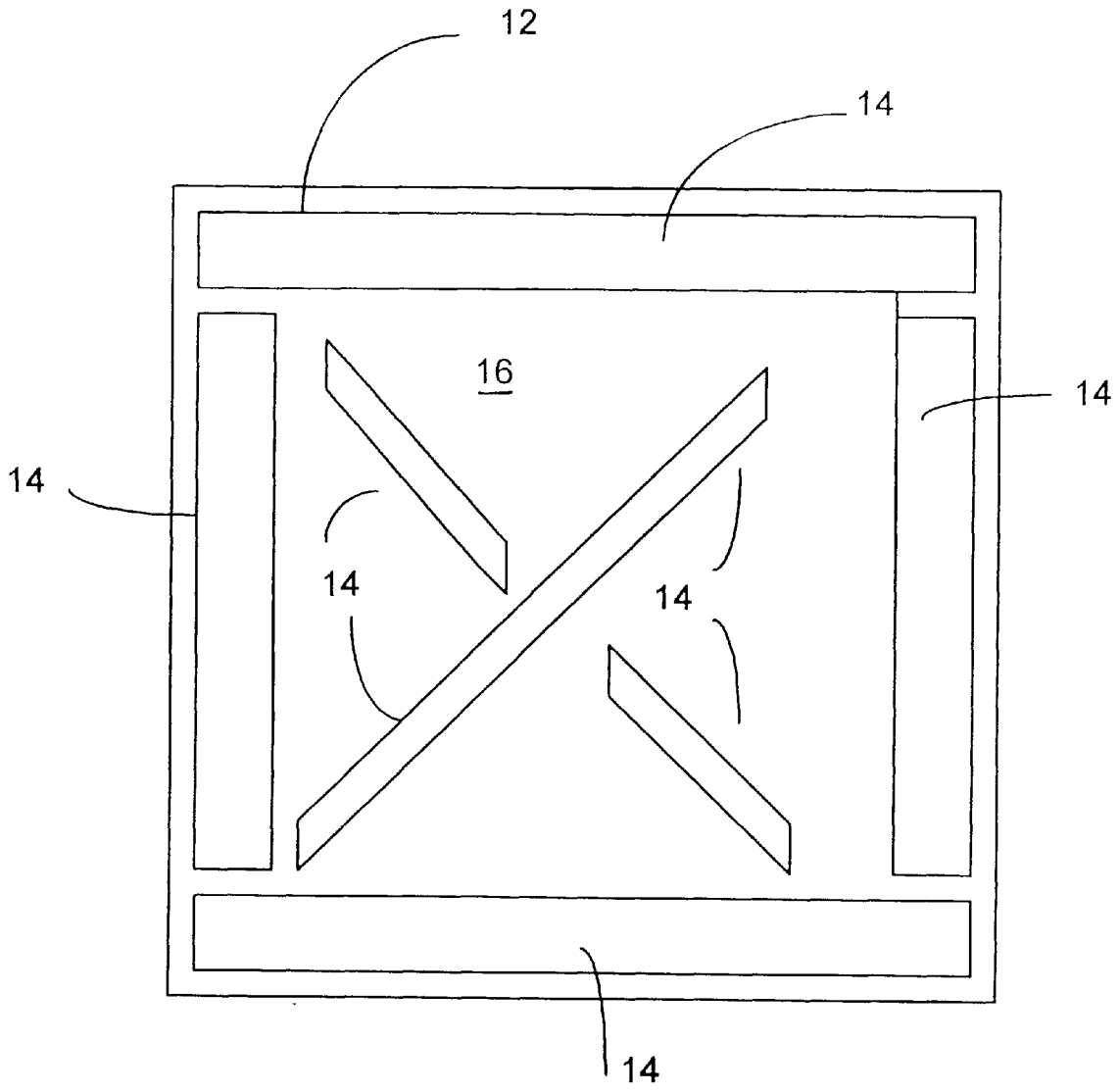
FIG. 3 is a substantially schematic bottom plan view showing an alternative layout of the anti-slip pad of the present invention.

Preferably, the anti-slip pad 14 will cover substantially the entire underside of the kneeling board 10. Alternatively, strips of the foam pad material may be removably attached by hook and loop fasteners (not visible in FIG. 3) along the periphery of the board, and crossing the board inside the periphery, as shown schematically in FIG. 3.

Anti-slip pad 14 may preferably be constructed of an open-cell foam material for anti-slip purposes, however, closed-cell foam material should also be suitable. The pad 14 preferably has a density in the range of about 1.5 to about 30 pounds per cubic foot (lb/ft.$^3$)

An even more preferred range of densities for the foam pad is between about 4.5 lb/ft.$^3$ and 16 lb/ft.$^3$, as products in that range are believed to provide a very desirable combination of high traction and suitably long wear, so that the pad need be replaced only infrequently. A open-cell foam pad having a density of about 15 lb/ft.$^3$ has been shown to be highly suitable for use.

Several types of foam material should be suitable for use. Polyurethane, Neoprene, Vinyl Nitrile, Styrene-Butadiene Rubber (SBR), Polyethylene (PE), ethyl vinyl acetate (EVA), ethylene propylene terpolymer (EPT), EPT/PE/ ButylRubber, Neoprene/EPT/SBR, epichlorohydrin (ECH), and nitrile (NBR) are among the types of polymers that would provide suitable foam layers for use as an anti-slip pad 14 in the present invention. Polyurethane is the preferred material at this time for the open-cell foam. Neoprene and vinyl/nitrile appear to be the most promising polymers among the above polymers for a closedcell foam, at the present time.

Polyurethane open-cell foam is believed to be commonly available in the preferred density range. Certain closed cell foams having the preferred characteristics noted above are commercially available through the Rubatex® company. Among the closed-cell foam products currently available through Rubatex, the products sold under the designations R-411-N (10–16 lb/ft.$^3$), R-1800-FS (4.5–8.5 lb/ft.$^3$), G-207-N (15–30 lb/ft.$^3$) and G-231-N (10–20 lb/ft.$^3$), are believed to be particularly suitable for use as anti-slip pads 14 when a closed-cell foam is used in the present invention.

The relatively high density and open-cell characteristics of the foam material are believed to be important features in terms of providing the necessary anti-slip characteristics for the anti-slip pad, as well as providing a desirable degree of durability as used in the roofing applications.

Various harder (less resilient) and softer (more resilient) materials may have drawbacks that render them unsuitable for providing an anti-slip pad for a kneeling board used by roofers and other persons working on roofs and other sloping surfaces. A non-foamed polymer material, for example, will generally lack sufficient resiliency or ability to deform under the weight of the kneeling board, and will thus not adequately grip the surface. The foams employed as the anti-slip pad 14 in the present invention provide greatly improved anti-slip characteristics, and the resiliency and softness (relative to the hardness of the gravel particles on the shingles) of the material allows the foam material to deform around the gravel particles and to securely grip the asphalt shingles. The anti-slip pad is able to conform to the rough, irregular surface by deforming around the gravel particles, instead of simply pushing against the particles, and possibly dislodging them in the process.

Closed-cell foam material, in general, appears to have a greater resistance to wear when used on shingles and roofing surfaces, as compared to open-cell foams that have previously been studied. However, open-cell foams appear generally to provide enhanced anti-slip properties. The use of a high-density closed-cell foam for the removable anti-slip pad 14 thus would provide the advantage of increased wear life. Because the pad is replaceable, however, the improved anti-slip properties of the open-cell foam makes it the preferred material. High-density open-cell and closed-cell foam anti-slip pads will also stand up reasonably well to other abrasive surfaces onto which the kneeling board 10 may be placed in a typical day, such as concrete sidewalks, and concrete or asphalt driveways.

The fastening means for the anti-slip pad 14 is preferably a sheet or layer 22 of the loop elements of a hook-and-loop type fastener substantially permanently secured to the anti-slip pad 14 by adhesive or other suitable means. One expected preferred manner of effecting a permanent securement of sheet 22 to anti-slip pad 14 is to laminate sheet 22 onto the foam layer 14 as the foam layer is being produced. The underside of the kneeling board 10 will have secured thereto a corresponding sheet 24 of hook-type fasteners, at a location where the pad 14 is to be secured. The sheet 24 of hook-type fasteners is desirably secured to the kneeling board 10 with a long-lasting adhesive, such as an epoxy-based adhesive. Fastening means other than hook-and-loop fasteners may be employed in place of the hook-and-loop fasteners.

The preferred thickness of the anti-slip pad 14 is in the range of ¼ inch to ¾ inch. If the anti-slip pad were thinner than ¼ inch, the anti-slip pad might not provide sufficient service life when used on a daily basis, as the foam will be worn away by the shingles. Anti-slip pads thicker than ¾ inch would provide even greater service life, but at the expense of making the pad 14 overly thick and possibly too far elevated from the work surface.

When the pad 14 becomes worn as a result of being abraded away during extended use, the worn pad 14 may be easily removed and a new pad 14 having a sheet 22 of the necessary type of fastening means may be quickly secured to the complementary fastening means 24 previously secured to the kneeling board 10.

It will be apparent to those skilled in the art that modifications and variations can be made to the kneeling board and removably attached anti-slip pad of the present invention, without departing from the scope or spirit of the present invention. Thus, it is intended that the present invention cover such modifications and variations of the invention, provided they come within the scope of the appended claims and their equivalents.

What is claimed is:

1. A kneeling board comprising:

a substantially rigid and planar board element;

a kneeling pad secured to an upper surface of said board element;

an anti-slip pad made of foam material so constructed and arranged to be removably secured to an underside of said board element, a first fastening element disposed on a first flat surface of said anti-slip pad;

a second fastening element secured to said underside of said board element;

said first and second fastening elements being so constructed and arranged so that said anti-slip pad is capable of being removed from said board element and is capable of being refastened to said board element, and wherein said board element further comdrises a foothold projection extending upwardly from said upper surface of said board element along a predetermined length of said upper surface, and wherein said kneeling pad is sized and positioned to be spaced apart from said foothold projection at a predetermined distance.

2. A kneeling board as recited in claim 1 wherein said foothold projection extends upwardly from said upper surface of said board element at a first edge of said board element.

3. A kneeling board as recited in claim 2 wherein one of said first fastening element and said second fastening element is a hook-type fastener element, and the other of said first fastening element and said second fastening element is a loop-type fastener element.

4. A kneeling board as recited in claim 2 wherein said anti-slip pad is constructed of a foam having a density in the range of about 1.5 lb/ft.$^3$ to about 30 lb/ft. $^3$.

5. A kneeling board as recited in claim 4 wherein said anti-slip pad is constructed of a foam having a density in the range of about 4.5 lb/ft.$^3$ to about 16 lb/ft.$^3$.

6. A kneeling board as recited in claim 5 wherein said anti-slip pad is constructed of a foam having a density of about 15 lb/ft.$^3$.

7. A kneeling board as recited in claim 6 wherein said foam is an open-cell foam.

8. A kneeling board as recited in claim 2 wherein said anti-slip pad has a thickness in a range of about ¼ inch to about ¾ inch.

9. A kneeling board as recited in claim 2 wherein said second fastening element on said anti-slip pad is a loop type fastener formed on a backing material, and wherein said anti-slip pad is integrally formed on said backing material.

10. A kneeling board as recited in claim 1 wherein said kneeling pad is constructed of a closed-cell foam material.

11. A kneeling board as recited in claim 1 wherein said kneeling pad is constructed of an open-cell foam material.

12. A kneeling board as recited in claim 11 wherein said kneeling pad has a water-impervious coating thereon.

13. A kneeling board as recited in claim 1 wherein said board element is made of a substantially rigid plastic material.

14. A kneeling board as recited in claim 2 wherein said foothold projection extends substantially perpendicularly upwardly from said board element.

15. A kneeling board as recited in claim 14 wherein said foothold projection is made of the same material as said board element, and is formed by plastically bending an edge of said board element.

16. A kneeling board as recited in claim 14 wherein said foothold projection extends upwardly to a distance on the order of five inches from said upper surface of said board element.

* * * * *